US008720100B1

(12) United States Patent
Calvert

(10) Patent No.: US 8,720,100 B1
(45) Date of Patent: May 13, 2014

(54) DUAL HANDGUN ASSEMBLY FOR CLOSE COMBAT

(71) Applicant: DHACC Associates, Trustee for DHACC CRT Trust, Manassas, VA (US)

(72) Inventor: S. Mill Calvert, Manassas, VA (US)

(73) Assignee: DHACC Associates, Manassas, VA (US), Trustee for DHACC CRT Trust ( * ) Notice: Subject to any disclaimer, the term of this patent is extended or adjusted under 35 U.S.C. 154(b) by 0 days.

(21) Appl. No.: 14/146,578

(22) Filed: Jan. 2, 2014

Related U.S. Application Data

(63) Continuation-in-part of application No. 14/102,941, filed on Dec. 11, 2013.

(51) Int. Cl.
*F41C 27/00* (2006.01)

(52) U.S. Cl.
CPC ..... *F41C 27/00* (2013.01)
USPC ..... 42/90; 42/106; 89/37.04

(58) Field of Classification Search
CPC ..... F41C 23/12; F41C 23/16; F41C 27/00; F41G 11/003; F41A 35/00; F41A 27/00; F41A 27/06; F41A 27/14
USPC ..... 42/72, 90, 105, 106; 89/37.01, 37.04
See application file for complete search history.

(56) References Cited

U.S. PATENT DOCUMENTS

| | | | | |
|---|---|---|---|---|
| 4,603,497 | A | 8/1986 | Crimmins, Jr. | |
| 7,467,490 | B2 * | 12/2008 | Mossberg et al. | 42/77 |
| 2009/0313873 | A1 * | 12/2009 | Roth | 42/72 |

* cited by examiner

*Primary Examiner* — Michael Carone
*Assistant Examiner* — Joshua Freeman
(74) *Attorney, Agent, or Firm* — Louis Ventre, Jr.

(57) ABSTRACT

A weapon system includes a first handgun, a second handgun and a clamp removably connecting the first handgun and the second handgun. The clamp includes a bracket securing to the first handgun over the grip and above the magazine butt plate. The clamp has a ball joint connected to the bracket below the magazine butt plate. The clamp includes a beam connected to the ball joint. The clamp includes an attachment brace connected to the distal end of the beam. The attachment brace releasably holds the second handgun. The attachment brace is tighten-able to the second handgun such that the muzzle of the second handgun can be adjusted to a rotatable position in three dimensions. The second handgun can also be fired when in such rotatable position.

6 Claims, 3 Drawing Sheets

DUAL HANDGUN ASSEMBLY FOR CLOSE COMBAT

CROSS-REFERENCE TO RELATED APPLICATIONS

This application is a continuation-in-part of application Ser. No. 14/102,941, filed 11-Dec.-2013, which is hereby incorporated by reference herein.

TECHNICAL FIELD

In the field of ordnance, an assembly of two handguns pivotally connected.

BACKGROUND ART

Law enforcement and crime fighting often involve armed conflict within close quarters of a house, apartment complex, warehouse or other building where the line of sight is often less than tens of feet and the potential for multiple opponents to attack from a concealed position may be high.

Police also may confront felons in a tenement house where a standard sidearm is available to confront hostilities that may arise. Similarly, a soldier may be tasked with operations in a city involving a mix of non-combatants and potential hostiles in a building.

More and more, military forces are required to engage an enemy in an urban environment where a handgun would be of greater operational support than a rifle. Confined spaces for close combat do not lend themselves to wielding a rifle for fast reactions to confront possible multiple armed hostiles.

Present technology discloses means for attaching accessories to a handgun in a fixed position and orientation, such as facing forward along the barrel line of sight. Laser sights and scopes are the most common attachment.

SUMMARY OF INVENTION

A weapon system includes a first handgun, a second handgun and a clamp removably connecting the first handgun and the second handgun. The clamp includes a bracket slidably securing to the first handgun over the grip and above the magazine butt plate. The bracket may come in two segments joined by a hinge so that a first segment can swing away from the magazine butt plate to enable instant removal and replacement of the magazine.

The clamp has a ball joint connected to the bracket below the magazine butt plate. The clamp includes a beam connected to the ball joint so that the beam is rotatable. The clamp includes an attachment brace connected to the distal end of the beam. The attachment brace releasably holds the second handgun. The attachment brace is tighten-able to the second handgun such that the muzzle of the second handgun can be adjusted to a rotatable position in three dimensions. The second handgun can also be fired when in such rotatable position. The beam is preferably somewhat L-shaped with a long section connected to the ball joint and a short section connected at an angle toward the second handgun. When the second handgun is a semi-automatic pistol, the attachment brace is constructed with a top segment that does not affect operability of the slide on the second handgun. Essentially, the top segment is not in contact with the second handgun and permits unimpeded movement of the slide. A bottom segment of the attachment brace secures the second handgun below the slide.

The weapons system may include a finger-operable set screw that when tightened engages the ball joint to add frictional resistance to rotation of the ball joint. The beam may be telescoping to permit adjustment of the position of the second handgun with respect to the first handgun.

Technical Problem

No combination weapon system is currently available to permit use of a primary handgun while having instantaneous availability of a second handgun that while attached to the primary handgun, can be pivoted in three degrees of freedom and discharged at a hostile that would otherwise require precious time to swing and re-aim the primary handgun.

There is no hand-carried weapon system available today that combines two semi automatic handguns so that the police officer has an immediately available and pivotable handgun for simultaneous use when holding and using his primary weapon. The problem with a pistol is that you can only shoot at one target at a time, and you cannot engage multiple targets at the same time. Many times a soldier or law enforcement officer is going through a building room by room and going around blind corners or walls with his gun drawn. The chance of that soldier or officer losing his life is higher if when he goes around a corner he encounters more than one gun pointed at him. With a traditional handgun, he can get off one shot at one of the enemy while he gets shot by the other person. If he had a handgun system that could accurately fire in two directions at the same time, his life might be spared.

Solution to Problem

The solution is a weapon system that the soldier or law enforcement officer can use to protect himself or herself and not become a name in stone on the wall of the Law Enforcement Memorial. Most officers will carry a backup pistol, but the problem is they can only shoot one at a time with any degree of accuracy. The dual handgun assembly for close combat not only provides a secondary weapon, but its engineering and hardware structure enable the officer to accurately shoot both weapons at the same time.

Advantageous Effects of Invention

The dual weapon system described herein has an easy slide-on/slide-off bracket when it attaches to the primary weapon, the first handgun, in a matter of seconds. The dual weapon system has a ball joint so the secondary pistol, the second handgun, is below the primary weapon and can be easily pivoted for a wide variety of shots. One hand grips the primary weapon, while the other hand grips the pivotable secondary pistol. In use, both of the officer's hands are in front of him, each hand holding one of the two handguns. This arrangement creates a steady hold whether just the primary weapon is fired or both are fired. This dual weapon system builds upon what is the typical hand stance to steady a pistol when held in front of the shooter with both hands.

A unique architecture and engineering structure of the combination weapon system enables the second handgun to be fired and reloaded without in anyway interfering with the mechanical processes of the second handgun or the primary handgun. It also enables the second handgun to be easily pivoted in many different directions, even if the secondary target is much higher up than the height of the primary handgun.

Each gun in the dual weapon system will preferably have a laser pointer. It will be easy for the officer to aim and focus on his primary target, while at the same time pivot the lower pistol to laser target the second criminal by using his peripheral vision field. Because both hands are steadily holding together the grips on both of the weapons, it will be easy to have split-second accuracy while aiming at the targets simultaneously.

When the officer is in more open territory and only needs his primary weapon, he can easily disengage the dual weapon system, sliding the primary handgun off of the clamp and either disengage the clamp from the second handgun and holster it, or simply store the second handgun with the clamp attached for immediate future use.

In order to change the clamp in his primary weapon, the dual weapon system can either be loosened and slid off, or if it has a hinge, the primary weapon can be tilted up to eject the clip and insert a new one. The specially engineered mounting hardware on the dual weapon system ensures that the operating features of the secondary pistol, such as slide movement, cartridge ejection, and cartridge reloading are not in any way interfered with.

The dual weapon system is a valuable tool for our law enforcement and military personnel. It will help to protect America and protect our bravest and finest that serve to protect us.

BRIEF DESCRIPTION OF DRAWINGS

The drawings illustrate preferred embodiments of a weapon system according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
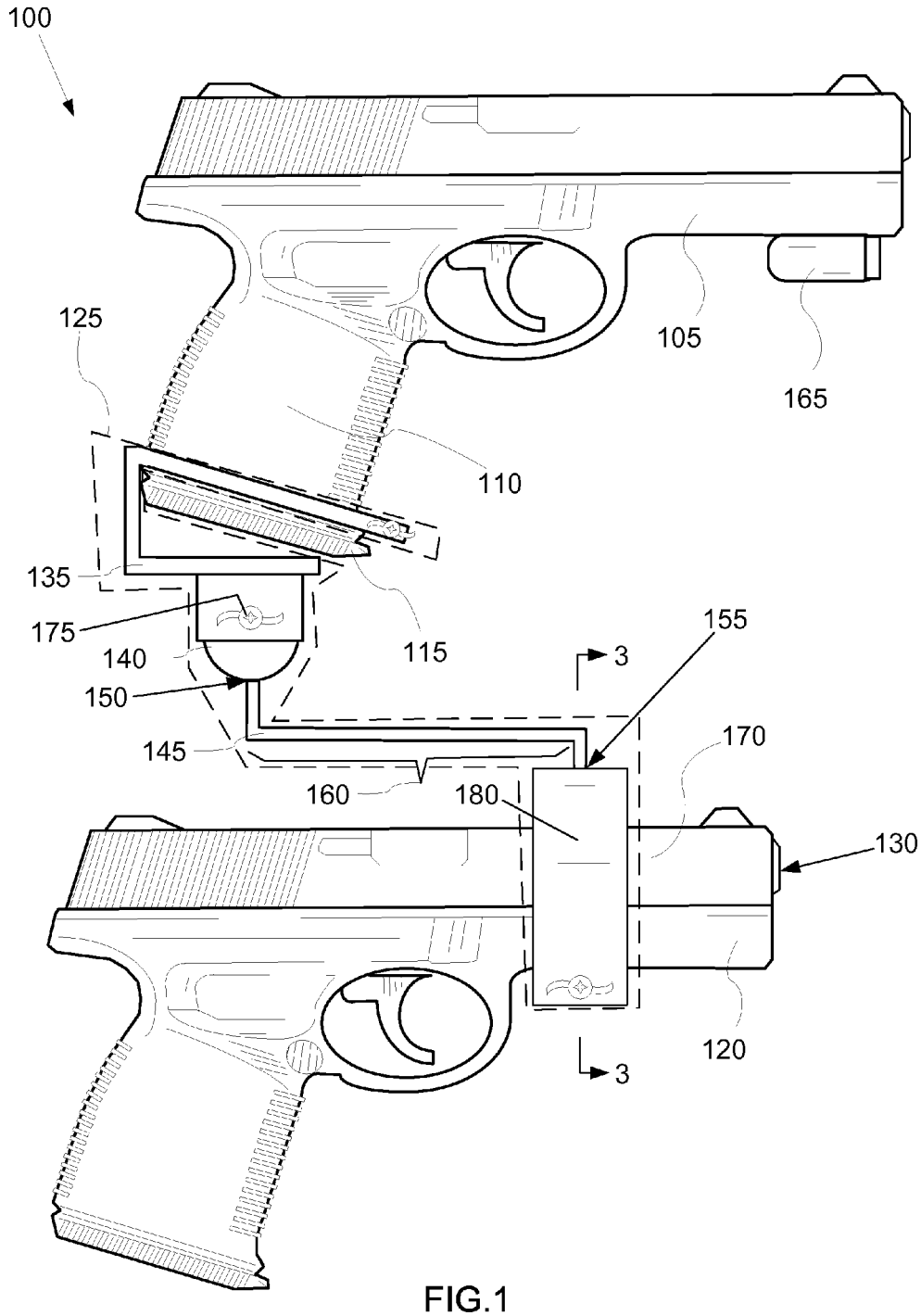
FIG. 1 is a side elevation view of a weapon system showing a first handgun and a second handgun clamped together to form a dual handgun assembly for close combat.

FIG. 1 illustrates a weapon system (100) according to the disclosure herein. The weapon system (100) includes a first handgun (105), a second handgun (120), and a clamp (125) that joins the first handgun (105) and the second handgun (120) so that one may be pivoted with respect to the other.

The first handgun (105) includes a grip (110) and a magazine butt plate (115). Because of these two features, the first handgun (105) is preferably a semi-automatic pistol, as shown. The grip (110) is intended to be held in the shooter's hand. The first handgun (105) may be equipped with a laser targeting pointer (165).

The second handgun (120) includes a muzzle (130), which is the open end of the hand-gun barrel where the bullet exits the second handgun (120). Preferably, the second handgun (120) is also a semi-automatic pistol, as shown. When the second handgun (120) is a semi-automatic, as illustrated in the drawings, it will typically have a slide (170). The slide (170) uses blowback, which upon firing the cartridge, causes the slide (170) to move backwards toward the shooter. A spring usually returns the slide (170) to the starting position while chambering a new cartridge from the magazine. Typically, the slide (170) also functions to eject the spent casing and cock the hammer for a follow-on shot. When the second handgun (120) is a revolver, it will typically include a cylinder containing multiple chambers and at least one barrel for firing. Typically, the cylinder revolves about an axis parallel to the barrel axis to align a chamber with the barrel for firing. The second handgun (120) is intended to be held in the shooter's other hand and may also have a laser targeting device similar to the laser targeting pointer (165) shown on the first handgun (105).

The clamp (125) is identified within the dashed enclosure in FIG. 1. The clamp (125) includes a bracket (135), a ball joint (140), a beam (145) and an attachment brace (180).

Figure 5:
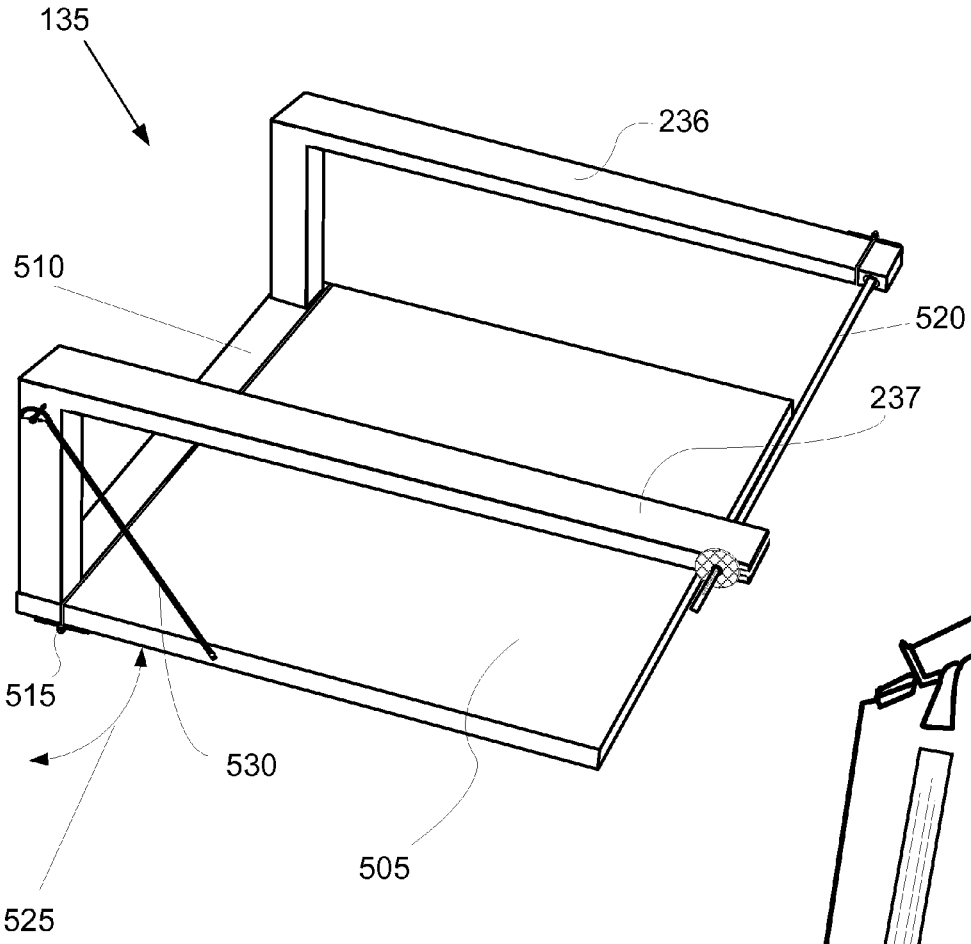
FIG. 5 is a perspective view of a bracket having hinged components.
Figure 6:
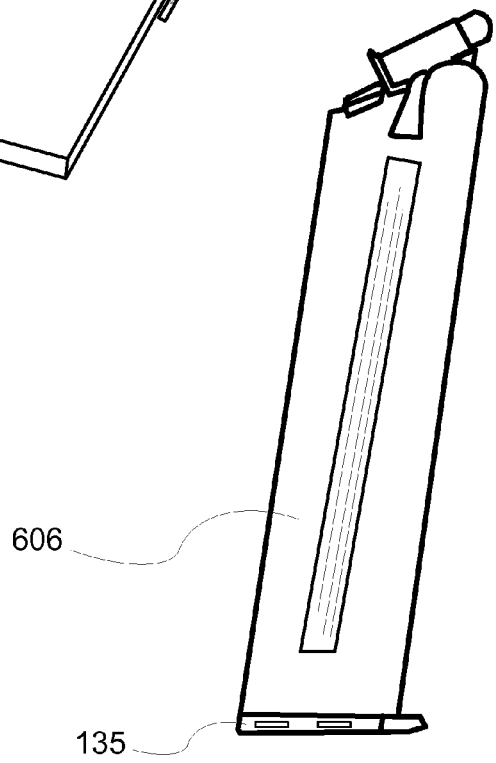
FIG. 6 is an elevation view of a magazine for a semi-automatic handgun.

The clamp (125) removably connects the first handgun (105) and the second handgun (120). The clamp (125) is preferably removably connected to the two handguns by nuts and bolts. Each of the bolts preferably has either a large knurled knob at the end or a wing nut, such that they may be tightened and loosened by hand and without additional tools. FIG. 5 illustrates a large knurled knob on the hinged bar (520) that may be used to tighten the bracket to the first handgun (105). In addition, the center of the bolts may include functionality for use with a tool so as to permit tightening and loosening with the tool. As examples, such functionality may be a hex key for an Allen wrench or a crosshead receptor for a Phillips screwdriver as shown in FIG. 1.

The clamp (125) includes a bracket (135) slidably securing to the first handgun (105) over the grip (110) and above the magazine butt plate (115). In a preferred embodiment shown in FIG. 2, two arms of the bracket (135), right arm (236) and left arm (237), are preferably pulled together by tightening a nut and bolt so as to bendably engage against the grip (110). The two arms may be contoured to conform to the shape of the grip (110). Also, while the first handgun (105) shown in FIG. 1 is an example of a pistol with a magazine butt plate (115) that slants downward, there are designs in which the butt plate is horizontal or is at another angle. Accordingly, the arms of the bracket (135) that cradle the grip would be angled to accommodate the design of the handgun to which it is to be secured. An alternate design with horizontal arms is shown in FIG. 5.

In an alternative embodiment, the securing mechanism is a hinged bar (520) that swings open at the right arm (236) to permit sliding in the first handgun (105). Once in place, the hinged bar rotates closed to latch at the other end on the left arm (237) with either a hand-tightening nut or an auto-engaging latch similar to that found on a fence gate. The hinged bar may have several notched locations to engage the latch so that a shooter would squeeze the arms together against the grip (110) and then push the hinged bar to engage the notched location that best engages the grip (110). The shooter would release the latch and swing the hinged bar open to release the first handgun (105) for removal from the bracket (135). Alternatively, a locking hasp may be used.

Other designs for slidably securing the bracket (135) to the first handgun (105) will be evident to persons of skill in the art.

In an alternative embodiment, the bracket (135) below the magazine butt plate (115) is composed of two portions that are hinged together to permit removing a magazine (606) from the first handgun (105). The magazine butt plate (115) is the bottom of a magazine (606) and when the magazine (606) is within the well of the handgun, the magazine (606) is typically removable by sliding out of the well of the handgun. Thus, in this embodiment, the first handgun (105) includes a magazine (606) and the bracket comprises a first portion (505) and a second portion (510), which when installed on the first handgun (105) reside below the magazine butt plate (115). The first portion (505) and the second portion (510) are joined by a hinge (515) and held in position by a locking rod (530). The locking rod (530) may rotate about a fixed position and attach using a carabiner-type clip with a spring-loaded gate for fast locking and unlocking. The hinge (515) is operable to swing the first portion (505) down and away from the magazine butt plate (115), generally in the direction shown by double-headed arrow (525) such that the magazine (606) can be removed from the first handgun (105) while the bracket (135) is attached to the first handgun (105).

The ball joint (140) is connected to the bracket (135) below the magazine butt plate (115). The ball joint (140) includes a ball within the ball joint (140) that can freely rotate within the ball joint (140). A finger-operable set screw (175) may be included that when tightened engages the ball joint (140) to add frictional resistance to rotation of the ball joint (140). The finger-operable set screw (175) may be used to fix the position of the ball in the ball joint (140), virtually preventing rotation.

The beam (145) has a proximal end (150) that is connected to the ball joint (140) so that the beam (145) is rotatable. While the beam (145) may be connected directly to the ball in the ball joint (140), there is preferably a short downward segment, as shown in FIG. 1, that is connected at the bottom of the ball in the ball joint (140) so that there is a greater range of swiveling the beam (145).

The beam (145) has a distal end (155), the end of the beam (145) opposite the proximal end (150). The distal end (155) is connected to the attachment brace (180). The beam (145) preferably extends forward so that the second handgun (120) can be positioned below and to the rear of the first handgun (105) for maximum comfort of the shooter.

The attachment brace (180) is connected to the distal end (155). The attachment brace (180) releasably holds the second handgun (120). The attachment brace (180) is tightenable to the second handgun (120) such that the muzzle (130) of the second handgun (120) can be adjusted to a rotatable position in three dimensions. Rotation in the ball joint (140) necessarily moves the muzzle (130) in three dimensions: up, down, left, right and forward and backward, although the last two are incremental in scope. Such rotation enables a shooter to reposition the muzzle (130) of the second handgun (120) so that it can be fired in virtually any direction, except that direction where the shooter or the first handgun (105) obstructs the line of sight.

Figure 3:
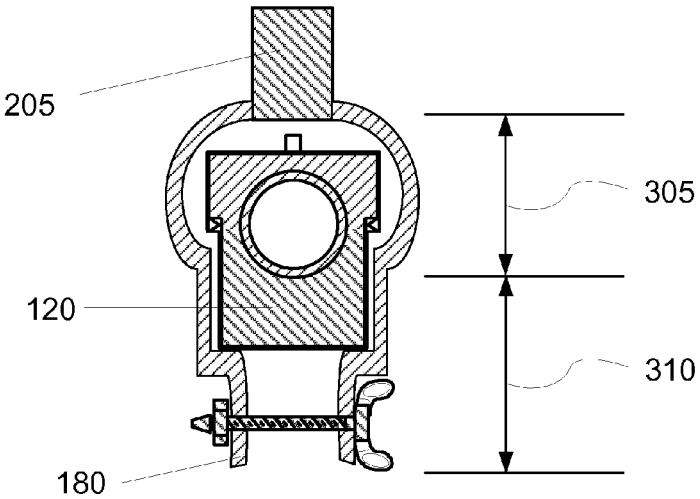
FIG. 3 is a sectional view taken along viewing lines 3-3 in FIG. 1, illustrating the attachment brace holding the second handgun.
Figure 4:
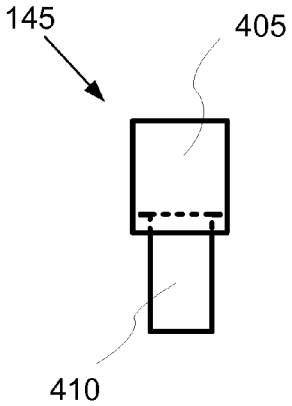
FIG. 4 is a top view of a beam that telescopes to reposition the second handgun with respect to the first handgun.

FIG. 3 is a sectional view taken along viewing lines 3-3 in FIG. 1, illustrating the attachment brace (180) holding the second handgun (120). The top segment (305) is not in direct physical contact with the second handgun (120). The bottom segment (310) is structured to engage the second handgun (120) below the slide (170), or in front of the revolving cylinder on its frame when the second handgun (120) is a revolver. Thus, the attachment brace (180) will not interfere with the firing of the second handgun (120) when in such rotatable position while the second handgun (120) is connected to the ball joint (140) through the attachment brace (180) and the beam (145).

Figure 2:
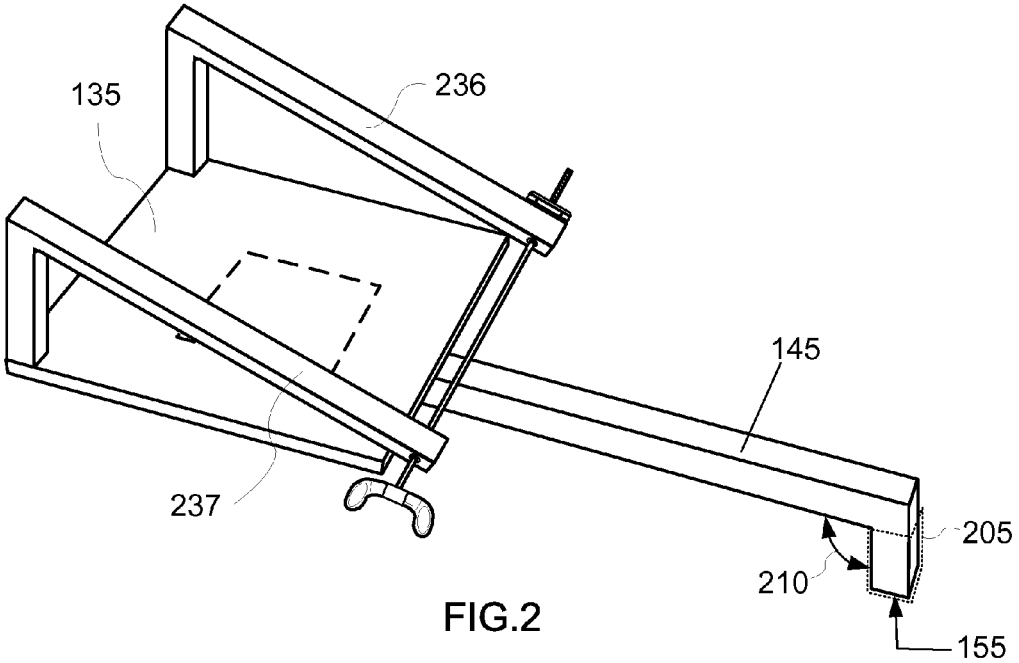
FIG. 2 is a perspective view of a bracket that slidably secures around the magazine butt plate of the first handgun and a beam extending from under the bracket.

The beam (145) may include a long section (160) beginning at the proximal end (150); and a short section (205), shown within the dashed enclosure in FIG. 2. In this embodiment, the short section is connected at an angle (210) to the long section (160) and extends toward the distal end (155). The angle (210) is preferably 90 degrees, but may be any other angle to enhance maneuverability of the second handgun (120).

The second handgun (120) is preferably a semi-automatic pistol that includes a slide (170). For this embodiment, the attachment brace (180) is constructed with a top segment (305) and a bottom segment (310). The bottom segment (310) contacts the second handgun (120) below the slide (170) so that it does not interfere with operation of the slide (170). The top segment (305) is not in contact with the second handgun (120) and permits unimpeded movement of the slide (170).

In an alternative embodiment of the weapon system (100), there is a finger-operable set screw (175) that when tightened engages the ball joint (140) to add frictional resistance to rotation of the ball joint (140). In a fully tightened position the second handgun (120) can be held fixed to permit steadying the aim of the first handgun (105).

In an alternative embodiment of the weapon system (100), the beam (145) telescopes in and out to enable adjustment of the second handgun (120) with respect to the first handgun (105). For this embodiment, the beam (145) includes an outer member (405) and an inner member (410), the inner member (410) telescoping within the outer member (405) so that the second handgun (120) can be positioned relative to the first handgun (105).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearms industry.

What is claimed is:

1. A weapon system comprising:

a first handgun comprising a grip, and a magazine butt plate;

a second handgun comprising a muzzle; and a clamp removably connecting the first handgun and the second handgun, the clamp comprising:

a bracket slidably securing to the first handgun over the grip and above the magazine butt plate;

a ball joint connected to the bracket below the magazine butt plate;

a beam comprising:

a proximal end connected to the ball joint so that the beam is rotatable; and a distal end; and an attachment brace connected to the distal end and releasably holding the second handgun, the attachment brace tighten-able to the second handgun such that the muzzle of the second handgun can be adjusted to a rotatable position in three dimensions, and such that the second handgun can be fired when in such rotatable position while connected to the ball joint.

2. The weapon system of claim 1, wherein the beam further comprises a long section beginning at the proximal end; and a short section connected at an angle to the long section and extending toward the distal end.

3. The weapon system of claim 1, wherein the second handgun is a semi-automatic pistol; wherein the second handgun further comprises a slide; wherein the attachment brace is constructed with a top segment and a bottom segment; wherein the bottom segment contacts the second handgun below the slide; and wherein the top segment is not in contact with the second handgun and permits unimpeded movement of the slide.

4. The weapon system of claim 1, further comprising a finger-operable set screw that when tightened engages the ball joint to add frictional resistance to rotation of the ball joint.

5. The weapon system of claim 1, wherein the beam further comprises an outer member and an inner member, the inner member telescoping within the outer member so that the second handgun can be positioned relative to the first handgun.

6. The weapon system of claim 1, wherein the first handgun further comprises a magazine; wherein the bracket comprises a first portion and a second portion below the magazine butt plate, said portions joined by a hinge; and the hinge operable to swing the first portion away from the magazine butt plate such that the magazine can be removed from the first handgun while the bracket is attached to the first handgun.

* * * * *